US005714249A

United States Patent [19]

Yoshida et al.

[11] Patent Number: 5,714,249

[45] Date of Patent: Feb. 3, 1998

[54] THERMAL TRANSFER RECORDING MATERIAL

[75] Inventors: Katsuhiro Yoshida; Kotaro Akashiro, both of Osaka, Japan

[73] Assignee: Fujicopian Co., Ltd., Japan

[21] Appl. No.: 662,533

[22] Filed: Jun. 13, 1996

[30] Foreign Application Priority Data

Jun. 13, 1995 [JP] Japan ..... 7-146121

[51] Int. Cl.[6] ..... B41M 5/26

[52] U.S. Cl. ..... 428/327; 428/195; 428/206; 428/323; 428/484; 428/413; 428/488.1

[58] Field of Search ..... 428/413, 484, 428/195, 323, 206, 327, 488.1

[56] References Cited

U.S. PATENT DOCUMENTS 5,328,754 7/1994 Yuyama et al. ..... 428/212

*Primary Examiner*—Pamela R. Schwartz

*Attorney, Agent, or Firm*—Fish & Neave

[57] ABSTRACT

A thermal transfer recording material is provided comprising a foundation and, provided thereon, a heat-meltable ink layer comprising an epoxy resin, a particulate wax having an average particle diameter of 0.05 to 15 μm and a pigment, the epoxy resin comprising not less than 50% by weight of at least one resin selected from the group consisting of tetraphenolethane tetraglycidyl ether, cresol novolac polyglycidyl ether, bisphenol A diglycidyl ether and bisphenol F diglycidyl ether.

5 Claims, 1 Drawing Sheet

THERMAL TRANSFER RECORDING MATERIAL

BACKGROUND OF THE INVENTION

The present invention relates to thermal transfer recording materials providing printed images having excellent fastness.

Conventional thermal transfer recording materials, in general, include those comprising a foundation and, applied onto the foundation, a heat-meltable ink containing a vehicle composed mainly of a wax or another type of heat-meltable ink containing a vehicle composed mainly of a resin for ensuring printed images of good quality even on paper sheets having relatively poor surface smoothness or printed images of high scratch resistance.

Recently, bar code printers and label printers using thermal transfer recording materials have been used to print bar codes or like codes for the management of parts or products in production processes of manufacturing factories, merchandise management in distribution field, management of articles at using sites, and the like. When used in, for example, distribution field, bar codes are frequently scratched or rubbed. Therefore, such bar codes are required to have particularly high scratch resistance.

Thermal transfer printers have also been used in the production of diversified products in small quantities, including outdoor advertising materials, election posters, common posters, standing signboards, stickers, catalogs, pamphlets, calenders and the like in the commercial printing field; bags for light packaging, labels of containers for foods, drinks, medicines, paints and the like, and binding tapes in the packaging field; and labels for indicating quality characteristics, labels for process control, labels for product management and the like in the apparel field. These articles are also required to exhibit scratch resistance.

With the conventional thermal transfer recording materials using the heat-meltable ink containing a vehicle composed mainly of a wax, however, resulting printed images exhibit poor scratch resistance though the ink enjoys satisfactory transferability. On the other hand, with the conventional thermal transfer recording materials using the heat-meltable ink containing a vehicle composed mainly of a resin such as ethylene-vinyl acetate copolymer, the transferability of the ink is inferior to the former ink due to its relatively high melt viscosity though resulting printed images enjoy relatively high scratch resistance.

It is, therefore, an object of the present invention to provide a thermal transfer recording material which is capable of exhibiting satisfactory transferability while at the same time forming printed images having excellent scratch resistance.

The foregoing and other objects of the present invention will be apparent from the following detailed description.

SUMMARY OF THE INVENTION

According to the present invention, there is provided a thermal transfer recording material comprising a foundation and, provided thereon, a heat-meltable ink layer comprising an epoxy resin, a particulate wax having an average particle diameter of 0.05 to 15 μm and a pigment, the epoxy resin comprising not less than 50% by weight of at least one resin selected from the group consisting of tetraphenolethane tetraglycidyl ether, cresol novolac polyglycidyl ether, bisphenol A diglycidyl ether and bisphenol F diglycidyl ether.

In one embodiment of the present invention, the total amount of the overall epoxy resin is from 50 to 90% by weight based on the total amount of the vehicle in the heat-meltable ink layer.

In another embodiment of the present invention, the particulate wax has a melting point of 60° to 130° C.

In still another embodiment of the present invention, the particulate wax comprises at least one wax selected from the group consisting of a polyethylene wax, an oxidized polyethylene wax, a polypropylene wax, an oxidized polypropylene wax, Fischer-Tropsch wax and carnauba wax.

In a further embodiment of the present invention, the mount of the particulate wax is from 10 to 50% by weight based on the total mount of the vehicle in the heat-meltable ink layer.

DETAILED DESCRIPTION

Figure 1:
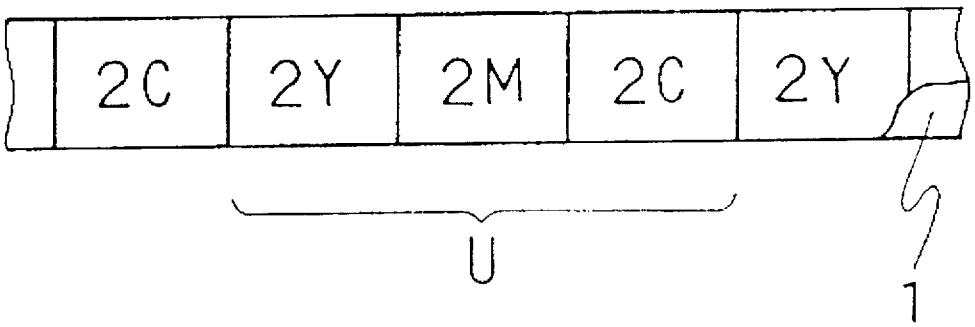
FIG. 1 is a partial plan view showing an example of an arrangement of color ink layers of respective colors in an embodiment of the thermal transfer recording material of the present invention.

The present invention will now be described in detail.

In the present invention, the vehicle of a heat-meltable ink layer comprises an epoxy resin, and a particulate wax having an average particle diameter of 0.05 to 15 μm, preferably 0.1 to 10 μm, the wax being dispersed in the epoxy resin. The ink layer containing such a vehicle provides an improved separability when being transferred. Further, since particles of the wax appear on the surface of printed images, the printed images enjoy improved scratch resistance. Herein, the term "separability of a heat-meltable ink layer" means that when being transferred, the heated portion of a heat-meltable ink layer is easily separated from the unheated portion of the heat-meltable ink layer and only the heated portion is transferred onto a receptor to give a sharp print image.

If the average particle diameter of the particulate wax is smaller than the above range, wax particles are submerged in the ink layer and hence have difficulty appearing on the surface of printed images, resulting in unsatisfactorily enhanced scratch resistance. If it is greater than the above range, the ink layer suffers poor separability, resulting in degraded transferability all the more.

To ensure improved scratch resistance, the particulate wax preferably has an average particle diameter 1 to 1.5 times as large as the mean thickness of those portions of the ink layer in which any wax particles are absent.

Examples of specific particulate waxes for use in the present invention are those formed from, either alone or in combination, vegetable waxes such as carnauba wax, candelilla wax and rice wax; animal waxes such as bees wax and lanolin; mineral waxes such as montan wax and ceresin wax; petroleum waxes such as paraffin wax and microcrystalline wax; and synthetic hydrocarbon waxes such as Fischer-Tropsch wax, polyethylene wax, oxidized polyethylene wax, polypropylene wax and oxidized polypropylene wax. These particulate waxes may be used either alone or in combination of two or more species. Particularly preferable among the above particulate waxes are those formed from polyethylene wax, oxidized polyethylene wax, polypropylene wax, oxidized polypropylene wax, Fischer-Tropsch wax and carnauba wax in terms of good slip properties of their particle surfaces.

The particulate wax preferably has a melting point of from 60° to 130° C., in particular from 80° to 110° C. If the melting point of the wax is lower than the above range, resulting printed images obtain unsatisfactorily improved scratch resistance because the wax is completely melted upon the thermal transfer process and, therefore, wax particles will not appear on the surface of the printed images and the desired slip property of the wax particle surfaces cannot be expected. On the other hand, if the melting point is higher than the above range, the ink layer tends to have degraded transferability because the wax is hardly melted upon thermal transfer process and, hence, will not contribute to the transferability of the ink layer.

The mount of the particulate wax to be blended is preferably within the range of 10 to 50% (% by weight, hereinafter the same), more preferably within the range of 15 to 50%, based on the total amount of the vehicle used in a heat-meltable ink layer. If the amount of the particulate wax is less than the above range or greater than the above range, resulting printed images often exhibit insufficiently improved scratch resistance.

The epoxy resin to be used in the present invention comprises not less than 50%, preferably not less than 70% of at least one resin selected from the group consisting of tetraphenolethane tetraglycidyl ether, cresol novolac polyglycidyl ether, bisphenol A diglycidyl ether and bisphenol F diglycidyl ether. The epoxy resin herein used is an uncured (or uncrosslinked) epoxy resin.

The four types of epoxy resins specified above provide better transferability than other epoxy resins and, therefore, are preferably used.

In the present invention it is particularly desirable that the epoxy resin be entirely composed of at least one of the above-specified epoxy resins. It is, however, not necessarily required to do so, and the epoxy resin comprising not less than 50%, preferably not less than 70% of at least one of the four specified epoxy resins can serve the purpose. If the proportion of such specified epoxy resin in the overall epoxy resin is less than the foregoing range, poor dispersibility of the pigment in the vehicle will result, thus deteriorating the transferability of the ink layer.

Further, the total amount of the overall epoxy resin in the vehicle is preferably 50 to 90%, more preferably 50 to 85%, most preferably 50 to 75%. If the total mount of the epoxy resin does not fall within the above range, it is difficult to accomplish the intended transferability.

Tetraphenolethane tetraglycidyl ether (hereinafter referred to as "TPETGE" as the need arises) as aforementioned, having a softening point of 92° C., is a species of polyfunctional epoxy resins and represented by the formula (I):

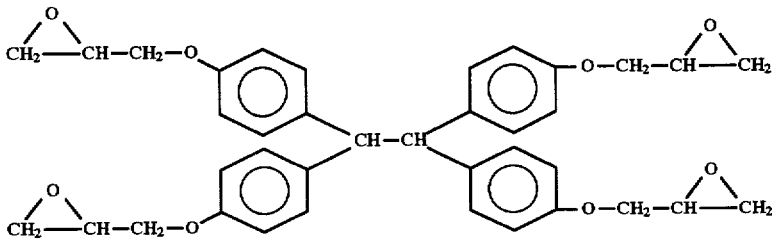

(I)

Cresol novolac polyglycidyl ether (hereinafter referred to as "CNPGE" as the need arises) as aforementioned is a species of polyfunctional epoxy resins. In the present invention examples of preferred cresol novolac polygylcidyl ethers include those represented by the formula (II):

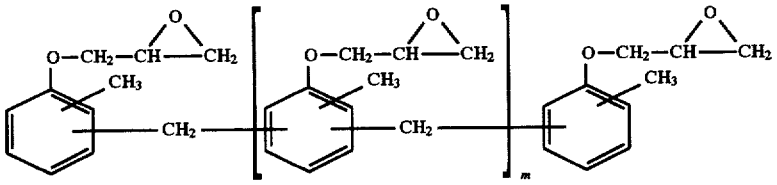

(II)

wherein m is usually an integer of from 3 to 7. CNPGEs useful in the present invention include mixtures of those of the formula (II) wherein values for m are different from each other. CNPGE preferably has a softening point of 60° to 120° C.

Bisphenol A diglycidyl ether (hereinafter referred to as "BPADGE" as the need arises) is a species of difunctional epoxy resins. Preferred are those represented by the formula (III):

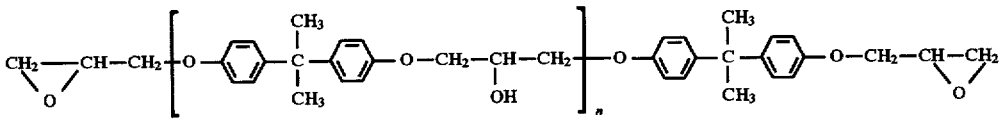

(III)

wherein n is usually an integer of from 0 to 13. BPADGEs useful in the present invention include mixtures of those of the formula (III) wherein values for n are different from each other. BPADGE preferably has a softening point of 60° to 140° C.

Bisphenol F diglycidyl ether (hereinafter referred to as "BPFDGE" as the need arises) is a species of difunctional epoxy resins. Preferred are those represented by the formula (IV):

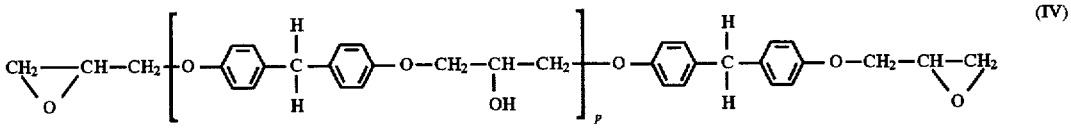

(IV)

wherein p is usually an integer of from 0 to 33. BPFDGEs useful in the present invention include mixtures of those of the formula (IV) wherein values for p are different from each other. BPFDGE preferably has a softening point of 60° to 140° C.

Examples of epoxy resins usable in combination with the aforementioned specified epoxy resins are:

(1) Glycidyl ether type epoxy resins including, for example, brominated bisphenol A diglycidyl ether, brominated bisphenol F diglycidyl ether, hydrogenated bisphenol A diglycidyl ether, glycerol triglycidyl ether and pentaerythritol diglycidyl ether;

(2) Glycidyl ether ester type epoxy resins including, for example, p-oxybenzoic acid glycidyl ether ester;

(3) Glycidyl ester type epoxy resins including, for example, phthalic acid diglycidyl ester, tetrahydrophthalic acid diglycidyl ester, hexahydrophthalic acid diglycidyl ester and dimer acid diglycidyl ester;

(4) Glycidyl amine type epoxy resins including, for example, glycidylaniline, triglycidyl isocyanurate and tetraglycidylaminodiphenylmethane;

(5) Linear aliphatic epoxy type epoxy resins including, for example, epoxidized polybutadiene and epoxidized soybean oil; and (6) Alicyclic epoxy type epoxy resins including, for example, 3,4-epoxy-6-methylcyclohexylmethyl 3,4-epoxy-6-methylcyclohexanecarboxylate and 3,4-epoxycyclohexylmethyl 3,4-epoxycyclohexanecarboxylate.

These epoxy resins may be used either alone or as mixtures of two or more species thereof. Preferably, epoxy resins useful in combination with the specified epoxy resins are those having softening points of not lower than 60° C. However, an epoxy resin in a liquid state can also be used so long as the vehicle resulting from mixing it with the specified epoxy resins or the epoxy resins usable in combination therewith has a softening point of not lower than 60° C.

The vehicle may be incorporated with one or more heat-meltable resins other than epoxy resins so long as the purpose of the present invention is attained. Examples of such heat-meltable resins include ethylene-vinyl acetate copolymer resin, ethylene-alkyl (meth)acrylate copolymer resin, phenolic resin, styrene-acrylic monomer copolymer resin, polyester resin and polyamide resin. Such heat-meltable resins are used in an amount of preferably not greater than 15%, more preferably not greater than 5% based on the total amount of the vehicle.

The softening point of the vehicle is preferably within the range of from 60° to 120° C. in terms of the storage stability and transferability of the thermal transfer recording material.

The proportion of the vehicle in the heat-meltable ink is preferably from about 40 to about 95% in terms of the transferability and like properties of the ink layer.

Usable as the pigment in the present invention are various organic and inorganic pigments as well as carbon black. Examples of such organic and inorganic pigments include azo pigments (such as insoluble azo pigments, azo lake pigments and condensed azo pigments), phthalocyanine pigments, nitro pigments, nitroso pigments, anthraquinonoid pigments, nigrosine pigments, quinacridone pigments, perylene pigments, isoindolinone pigments, dioxazine pigments, titanium white, calcium carbonate and barium sulfate. The proportion of the pigment in the ink layer is suitably within the range of from 5 to 60%.

Yellow pigments, magenta pigments, and cyan pigments, and optionally black pigments are used for forming multicolor or full-color printed images utilizing subtractive color mixture.

The pigments for yellow, magenta and cyan for use in the ink layer are preferably transparent, while the pigments for black are usually opaque.

Examples of transparent yellow pigments include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake. These pigments may be used either alone or in combination of two or more species thereof.

Examples of transparent magenta pigments include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y, Arizalin Lake and Quinacridone Red. These pigments may be used either alone or in combination of two or more species thereof.

Examples of transparent cyan pigments include organic pigments such as Victoria Blue Lake, metal-free Phthalocyanine Blue, Phthalocyanine Blue and Fast Sky Blue. These pigments may be used either alone or in combination of two or more species thereof.

The term "transparent pigment" means a pigment which gives a transparent ink when dispersed in a transparent vehicle.

Examples of black pigments include inorganic pigments having insulating or conductive properties such as carbon black, and organic pigments such as Aniline Black. These pigments may be used either alone or in combination of two or more species thereof.

The proportion of the pigment in respective color ink layer is usually from about 5 to about 60%.

In the present invention the heat-meltable ink layer may be incorporated with appropriate additives such as a dispersing agent as well as the aforementioned ingredients.

The heat-meltable ink layer can be formed by applying to a foundation a coating liquid prepared by dissolving or dispersing the epoxy resin and the particulate wax in a solvent which is capable of dissolving the epoxy resin but incapable of dissolving the particulate wax or by dispersing the epoxy resin and the particulate wax in a solvent which is capable of dissolving neither the epoxy resin nor the particulate wax and then dissolving or dispersing the pigment together with other additives, followed by drying at such a temperature range as not to ruin the particle form of the particulate wax.

The coating amount (on a solid basis, hereinafter the same) of the heat-meltable ink layer in the present invention is usually 0.02 to 5 g/m$^2$, preferably 0.5 to 3 g/m$^2$.

As the foundation for the thermal transfer recording material of the present invention, one can use polyester films such as polyethylene terephthalate film, polybutylene terephthalate film, polyethylene naphthalate film, polybutylene naphthalate film and polyarylate film, polycarbonate film, polyamide film, aramid film, polyether sulfone film, polysulfone film, polyphenylene sulfide film, polyether ether ketone film, polyether imide film, modified polyphenylene ether film and polyacetal film, and other various plastic films commonly used for the foundation of ink ribbons of this type. Alternatively, thin paper sheets of high density such as condenser paper can also be used. The thickness of the foundation is usually from about 1 to about 10 μm. From the standpoint of reducing heat spreading to increase the resolution of printed images, the thickness of the foundation is preferably from 1 to 6 μm.

Where the thermal transfer recording material of the present invention is to be used in a thermal transfer printer with a thermal head, a conventionally known stick-preventive layer is preferably provided on the back side (the side to be brought into slide contact with the thermal head) of the foundation. Examples of materials for the stick-preventive layer include various heat-resistant resins such as silicone resins; fluorine-containing resins and nitrocellulose resins, and other resins modified with these heat-resistant resins such as silicone-modified urethane resins and silicone-modified acrylic resins, and mixtures of the foregoing heat-resistant resins and lubricating agents.

The term "thermal transfer recording material" as used herein means to include a thermal transfer recording material for forming monochromatic images, and a thermal transfer recording material for forming multi-color or full-color images utilizing subtractive color mixture.

The thermal transfer recording material for forming monochromatic images is of a structure in which a monochromatic heat-meltable ink layer is provided on a foundation. Colors for the monochromatic heat-meltable ink layer include black, red, blue, green, yellow, magenta and cyan.

An embodiment of the thermal transfer recording material for forming multi-color or full-color images is of a structure in which on a single foundation are disposed a yellow heat-meltable ink layer, a magenta heat-meltable ink layer and a cyan heat-meltable ink layer and, optionally, a black heat-meltable ink layer in a side-by-side relation. Such color ink layers can be variously disposed on a foundation depending on the kind of printer.

FIG. 1 is a partial plan view showing an example of the thermal transfer recording material according to the foregoing embodiment. As shown in FIG. 1, on a single foundation 1 are disposed a yellow heat-meltable ink layer 2Y, a magenta heat-meltable ink layer 2M and a cyan heat-meltable ink layer 2C in a side-by-side relation. These ink layers 2Y, 2M and 2C, each having a predetermined constant size, are periodically disposed longitudinally of the foundation 1 in recurring units U each comprising ink layers 2Y, 2M and 2C arranged in a predetermined order. The order of arrangement of these color ink layers in each recurring unit U can be suitably determined according to the order of transfer of the color ink layers. Each recurring unit U may comprise a black ink layer in addition to the layers 2Y, 2M and 2C.

Another embodiment of the thermal transfer recording material for forming multi-color or full-color images is a set of thermal transfer recording materials comprising a first thermal transfer recording material having a yellow heat-meltable ink layer on a foundation, a second thermal transfer recording material having a magenta heat-meltable ink layer on another foundation, and a third thermal transfer recording material having a cyan heat-meltable ink layer on yet another foundation, and, optionally a fourth thermal transfer recording material having a black heat-meltable ink layer on still another foundation.

The use of any of the foregoing embodiments of the thermal transfer recording materials will give multi-color or full-color images having excellent scratch resistance. Further, individual color heat-meltable ink layers in the present invention have excellent superimposing properties, thus ensuring multi-color or full-color images of superior color reproducibility.

To form printed images using the thermal transfer recording material of the present invention the ink layer is superimposed on an image-receiving body and heat energy is applied imagewise to the ink layer. A thermal head is typically used as a heat source of the heat energy. Alternatively, any conventional heat sources can be used such as laser light, infrared flash and heat pen.

Where the image-receiving body is not a sheet-like material but a three-dimensional article, or one having a curved surface, thermal transfer using laser light is advantageous since application of heat energy is easy.

The formation of multi-color or full-color images with use of the thermal transfer recording material of the present invention is performed, for example, as follows. With use of a thermal transfer printer with one or plural thermal heads the yellow ink layer, the magenta ink layer and the cyan ink layer are selectively melt-transferred onto a receptor in a predetermined order in response to separation color signals of an original multi-color or full-color image, i.e., yellow signals, magenta signals and cyan signals to form yellow ink dots, magenta ink dots and cyan ink dots on the receptor in a predetermined order, thus yielding a yellow separation image, a magenta separation image and a cyan separation image superimposed on one another on the receptor. The order of transfer of the yellow ink layer, magenta ink layer and cyan ink layer can be determined as desired. When a usual multi-color or full-color image is formed, all the three color ink layers are selectively transferred in response to the corresponding three color signals to form three color separation images on the receptor. When there are only two color signals, the corresponding two of the three color ink layers are selectively transferred to form two color separation images.

Thus there is obtained a multi-color or full-color image comprising: (A) at least one region wherein a color is developed by subtractive color mixture of at least two superimposed inks of yellow, magenta and cyan, or (B) a combination of the region (A) and at least one region of a single color selected from yellow, magenta and cyan where different color inks are not superimposed. Herein a region where yellow ink dots and magenta ink dots are present in a superimposed state develops a red color; a region where yellow ink dots and cyan ink dots are present in a superimposed state develops a green color; a region where magenta ink dots and cyan ink dots are present in a superimposed state develops a blue color; and a region where yellow ink dots, magenta ink dots and cyan ink dots are present in a superimposed state develops a black color. A region where only yellow, magenta or cyan ink dots are present develops a yellow, magenta or cyan color.

In the above manner a black color is developed by the superimposing of yellow ink dots, magenta ink dots and cyan ink dots. A black color may otherwise be obtained by using only black ink dots instead of three color ink dots. Further alternatively, a black color may be obtained by superimposing black ink dots on at least one of yellow, magenta and cyan ink dots, or on superimposed ink dots of at least two of yellow, magenta and cyan ink dots.

In forming printed images with use of the thermal transfer recording material, the printed images may be directly formed on a final object, or alternatively by previously forming the printed images on a sheet-like image-receiving body (receptor) and then bonding the image-receiving body thus bearing the printed images to a final object with suitable means such as an adhesive.

The present invention will be more fully described by way of Examples and Comparative Examples. It is to be understood that the present invention is not limited to these Examples, and various changes and modifications may be made in the invention without departing from the spirit and scope thereof.

EXAMPLES 1–7 AND COMPARATIVE EXAMPLES 1–3

A 5 μm-thick polyethylene terephthalate film was formed on one side thereof with a stick-preventive layer composed of a silicone resin with a coating mount of 0.25 g/m$^2$. Onto the opposite side of the polyethylene terephthalate film with respect to the stick-preventive layer was applied an ink coating liquid of the formula shown in Table 1, followed by drying at 70° C. to form a heat-meltable ink layer with a coating amount of 2 g/m$^2$, yielding a thermal transfer recording material.

It should be noted that in Table 1 the average particle diameter of wax particles in a wax dispersion or a wax powder was measured using a laser diffraction particle size distribution measuring apparatus (SALD-1100 available from SHIMADZU CORPORATION).

Using each of the thermal transfer recording materials thus obtained, printing was performed to print bar code patterns on a receptor (available from Lintech Corp. under the commercial name "Gin Nema") with a thermal transfer type bar code printer (B-30 made by TEC Corp.) under the following conditions:

Applied energy: 22.6 mJ/mm$^2$

Printing speed: 2 inches/second

Platen pressure: "High" in terms of an indication prescribed in the printer

Note that the receptor used herein comprised a polyester film having on one side thereof an aluminum deposition layer and an adhesive layer thereon and was adapted to receive printed images on the polyester film surface thereof.

The resulting printed images were evaluated for their transferability and scratch resistance (crocking resistance and smear resistance).

The results are shown in Table 2.

Transferability

Using a bar code reader (Codascan II produced by RJS ENTERPRISES, INC), the printed images were subjected to a reading test according to the following judgment criteria:

○: completely readable;

Δ: partially readable; and

X: impossible to read.

Scratch Resistance (Crocking Resistance)

The printed images were rubbed under the following conditions and then subjected to the reading test as above.

Tester: A.A.T.C.C. Crock Meter Model CM-1 produced by ATLAS ELECTRIC DEVICE COMPANY Rubbing material: Cotton cloth Pressure: 500 g/cm$^2$

TABLE 1

| | Ex. 1 | Ex. 2 | Ex. 3 | Ex. 4 | Ex. 5 | Ex. 6 | Ex. 7 | Com. Ex. 1 | Com. Ex. 2 | Com. Ex. 3 |
|---|---|---|---|---|---|---|---|---|---|---|
| Formula of ink coating liquid (%) | | | | | | | | | | |
| Epikote 1031S *1 | 10 | 10 | | | | 10 | 6 | | | |
| Araldite ECN1280 *2 | | | 10 | | | | | | | |
| Epikote 1003 *3 | | | | 10 | | | 4 | 14 | 10 | 4 |
| Epikote 4007P *4 | | | | | 10 | | | | | |
| X-7204 *5 | 40 | | | | | | 40 | | | |
| Polymist B-6 *6 | | 4 | | | | | | | | |
| X-7148 *7 | | | 40 | 40 | 40 | | | | | |
| FIP-1005 *8 | | | | | | 4 | | | | |
| A-C7 *9 | | | | | | | | | 4 | 4 |
| Ethylene-vinyl acetate copolymer *10 | | | | | | | | | | 6 |
| Carbon black | 6 | 6 | 6 | 6 | 6 | 6 | 6 | 6 | 6 | 6 |
| Methyl ethyl ketone | 44 | 80 | 44 | 44 | 44 | 80 | 44 | 80 | 80 | 80 |
| Softening point of vehicle (°C.) | 92 | 92 | 80 | 89 | 109 | 92 | 91 | 89 | 89 | 86 |

*1 TPETGE made by Yuka Shell Epoxy Kabushiki Kaisha, softening point: 92° C.
*2 CNPGE made by Asahi-CIBA Limited, softening point: 80° C.
*3 BPADGE made by Yuka Shell Epoxy Kabushiki Kaisha, softening point: 89° C.
*4 BPFDGE made by Yuka Shell Epoxy Kabushiki Kaisha, softening point: 109° C.
*5 Oxidized polyethylene wax dispersion (10% solid content) made by GIFU SHELLAC MFG. CO., LTD., melting point: 102° C., average particle diameter: 3 μm
*6 Polyethylene wax powder made by Allied Signal Co., melting point: 126° C., average particle diameter: 6 μm
*7 Polyethylene wax dispersion (10% solid content) made by GIFU SHELLAC MFG. CO., LTD., melting point: 102° C., average particle diameter: 3 μm
*8 Fischer-Tropsch wax powder made by Nippon Seiro Co., Ltd., melting point: 106° C., average particle diameter: 4 μm
*9 Polyethylene wax powder made by Allied Signal Co., melting point: 107° C., average particle diameter: 20 μm
*10 a product of Nippon Unicar Company Limited, melt index: 2500, softening point: 84° C.

Number of reciprocations: 300

Scratch Resistance (Smear Resistance)

The printed images were rubbed under the following conditions and then subjected to the reading test as above.

Tester: Rub Tester produced by Yasuda Seiki Seisakusho Ltd.

Rubbing material: Corrugated fiberboard

Pressure: 250 g/cm$^2$

Number of reciprocations: 300

TABLE 2

| | Transferability | Crocking Resistance | Smear resistance |
|---|---|---|---|
| Ex. 1 | ○ | ○ | ○ |
| Ex. 2 | ○ | ○ | ○ |
| Ex. 3 | ○ | ○ | ○ |
| Ex. 4 | ○ | ○ | ○ |
| Ex. 5 | ○ | ○ | ○ |
| Ex. 6 | ○ | ○ | ○ |
| Ex. 7 | ○ | ○ | ○ |
| Com. Ex. 1 | Δ | Δ | Δ |
| Com. Ex. 2 | X | Δ | Δ |
| Com. Ex. 3 | Δ | X | X |

As seen from the foregoing, the thermal transfer recording material of the present invention offers excellent transferability and provides printed images exhibiting high scratch resistance and hence is highly useful in printing images such as bar codes.

In addition to the materials and ingredients used in the Examples, other materials and ingredients can be used in Examples as set forth in the specification to obtain substantially the same results.

What we claim is:

1. A thermal transfer recording material comprising a foundation and, provided thereon, a heat-meltable ink layer comprising a vehicle and a pigment, the vehicle comprising an epoxy resin and a particulate wax having an average particle diameter of 0.05 to 15 μm, the epoxy resin comprising not less than by weight of at least one resin selected from the group consisting of tetraphenolethane tetraglycidyl ether, cresol novolac polyglycidyl ether, bisphenol A diglycidyl ether and bisphenol F diglycidyl ether.

2. The thermal transfer recording material of claim 1, wherein the epoxy resin comprises from 50 to 90% by weight of the vehicle in the heat-meltable ink layer.

3. The thermal transfer recording material of claim 1, wherein the particulate wax has a melting point of 60° to 130° C.

4. The thermal transfer recording material of claim 1, wherein the particulate wax comprises at least one wax selected from the group consisting of polyethylene wax, oxidized polyethylene wax, polypropylene wax, oxidized polypropylene wax, Fischer-Tropsch wax and carnauba wax.

5. The thermal transfer recording material of claim 1, wherein the particulate wax comprises from 10 to 50% by weight of the vehicle in the heat-meltable ink layer.

* * * * *

UNITED STATES PATENT AND TRADEMARK OFFICE

CERTIFICATE OF CORRECTION

PATENT NO. : 5,714,249
DATED : February 3, 1998
INVENTOR(S) : Katsuhiro Yoshida, et al.

It is certified that error appears in the above-identified patent and that said Letters Patent is hereby corrected as shown below:

Column 2, line 13 delete "mount" and substitute therefor -- amount --.

Column 2, line 14 delete "mount" and substitute therefor -- amount --.

Column 3, line 14 delete "mount" and substitute therefor -- amount --.

Column 4, line 8 delete "mount" and substitute therefor -- amount --.

Column 9, line 25 delete "mount" and substitute therefor -- amount --.

Column 12, line 11 after "than" insert -- 50% --.

Signed and Sealed this

Twenty-sixth Day of December, 2000

*Attest:*

*Attesting Officer*

Q. TODD DICKINSON

*Director of Patents and Trademarks*